US006152551A

United States Patent [19]

Annas

[11] Patent Number: 6,152,551

[45] Date of Patent: Nov. 28, 2000

[54] ENTERTAINMENT WARDROBE WITH TWO-WAY MIRROR

[75] Inventor: Timothy L. Annas, Newton, N.C.

[73] Assignee: La-Z-Boy, Inc., Monroe, Mich.

[21] Appl. No.: 09/289,820

[22] Filed: Apr. 12, 1999

[51] Int. Cl.[7] ..... A47B 67/00

[52] U.S. Cl. ..... 312/224; 312/204; 312/227

[58] Field of Search ..... 312/224, 7.1, 7.2, 312/114, 138.1, 242, 204, 237, 226, 227, 326; 359/839

[56] References Cited

U.S. PATENT DOCUMENTS

| | | | |
|---|---|---|---|
| 1,006,481 | 10/1911 | Johnson et al. | 312/227 X |
| 1,690,404 | 11/1928 | Dieckmann | 312/204 |
| 1,857,716 | 5/1932 | Farrell et al. | 312/7.1 |
| 1,917,544 | 7/1933 | Shearer | 312/7.1 X |
| 5,127,719 | 7/1992 | Battista | 312/204 |
| 5,165,769 | 11/1992 | Wolfe | 312/227 |
| 5,368,378 | 11/1994 | Curtis | 312/242 X |
| 5,575,552 | 11/1996 | Faloon et al. | 359/839 |
| 5,577,819 | 11/1996 | Olsen | 312/242 |
| 5,688,031 | 11/1997 | Tryon | 312/257.1 |
| 5,742,442 | 4/1998 | Allsup et al. | 359/839 |
| 5,838,808 | 11/1998 | Prosser | 297/217.1 X |

*Primary Examiner*—Peter M. Cuomo
*Assistant Examiner*—Stephen Vu
*Attorney, Agent, or Firm*—Harness, Dickey & Pierce, P.L.C.

[57] ABSTRACT

A storage device for a video display which includes an appropriately sized furniture-grade cabinet and a two-way mirror. The cabinet permits the video display to be positioned in an elevated location, permitting the video display to be comfortably viewed from a recumbent position. When the video display is not in use, the two-way mirror conceals its presence. However, when the video display is in use, the light produced by the display is transmitted through the mirror, permitting the video display to be viewed through the two-way mirror. The material from which two-way mirror is constructed permits infra-red signals from remote control device for the video equipment to travel through the two-way mirror and control the video equipment. The functionality of the storage device is further enhanced through the incorporation of several other features, including adjustable shelves and drawers.

13 Claims, 5 Drawing Sheets

FIG 3
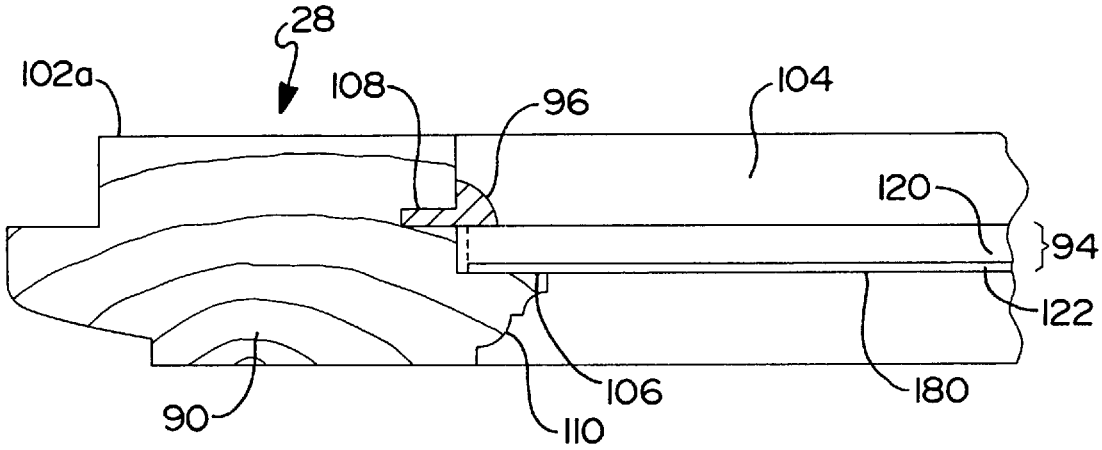
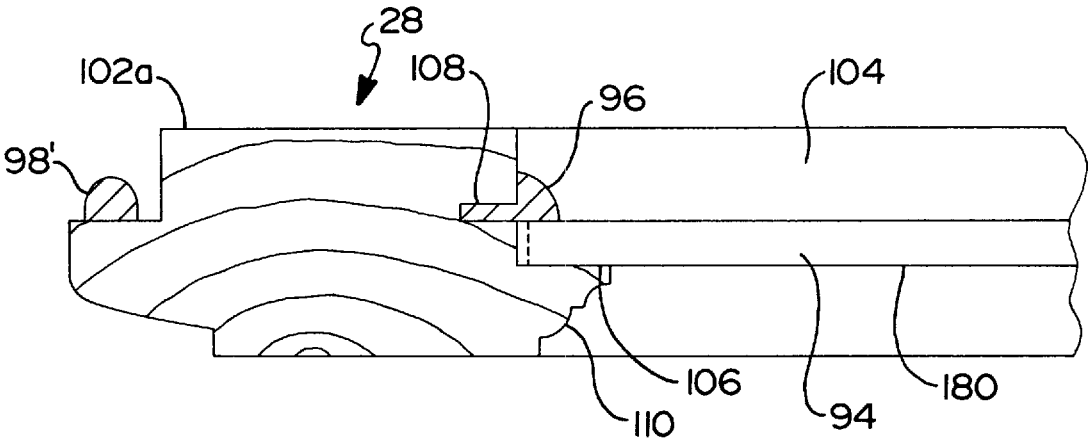
FIG 3A

FIG 5
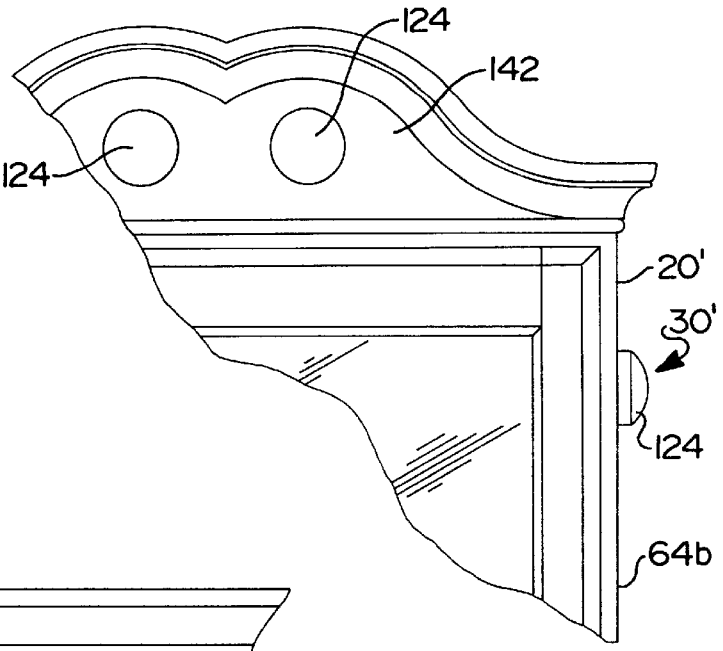
FIG 6
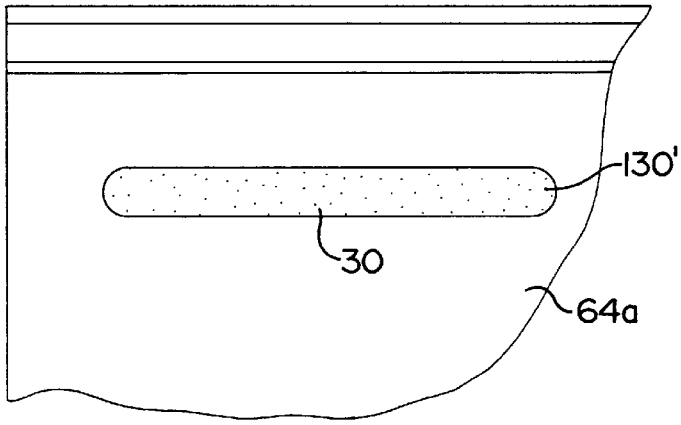
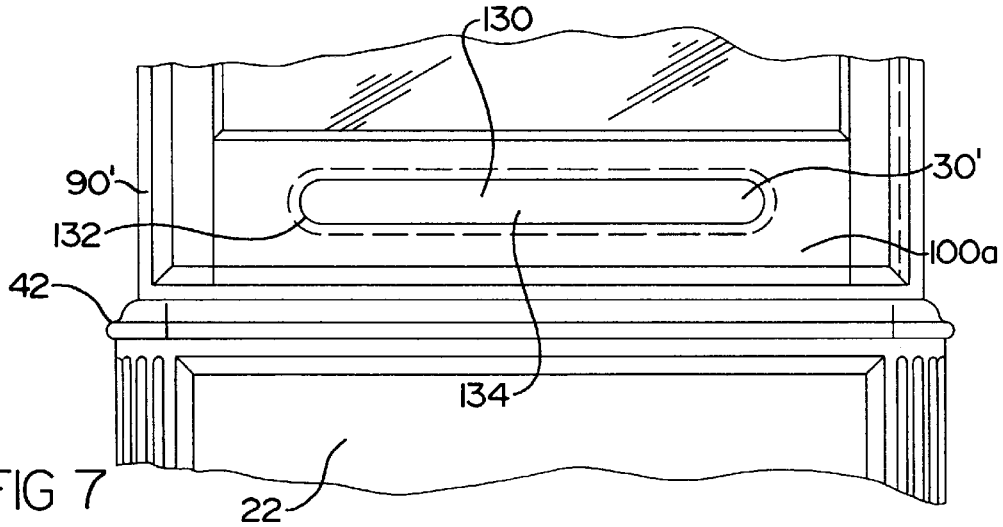
FIG 7

ENTERTAINMENT WARDROBE WITH TWO-WAY MIRROR

BACKGROUND OF THE INVENTION

1. Technical Field

The present invention relates generally to video display storage devices and more particularly to a video display storage device which incorporates a two-way mirror to conceal the presence of a video display when the video display is not in use.

2. Discussion

With the advent of surround sound systems, advanced video game systems, and Internet television equipment, manufacturers of video display storage devices have developed entertainment centers to allow consumers to cluster this equipment together in a central location where it may be used by several persons in a large viewing space. In keeping with this trend, many of the entertainment centers presently manufactured are large and impressive units, tailored specifically to the storage and use of the entertainment equipment.

To prevent the video display from becoming the focal point of the room decor when it is not in use, many of the prior art entertainment centers utilize retracting or sliding doors to conceal the video display. This strategy, however, has several drawbacks including increased costs for hardware and construction and decreased convenience to the user of the entertainment center due to the need to open and close the doors prior to and after using the video display. Furthermore, the use of large doors to cover the video display has a tendency to simply shift the focal point of the decor of a room from the video display to the entertainment center doors.

The above noted problems are more apparent when the size of the room is relatively small and not used for the sole purpose of entertainment. Such entertainment centers are typically not integrated satisfactorily into multi-purpose rooms such as dens, home offices and bedrooms where additional flexibility is required. Examples of such flexibility include the ability to alter the height of the equipment to enable the occupants of the room to view and operate the equipment from the desired viewing location and the ability to use the entertainment center for additional storage of non-entertainment related materials.

Accordingly, there remains a need in the art for an improved entertainment storage device which stores a video display device in a concealing manner when not in use and which permits the video display device to be used without opening the door of the storage device. There also remains a need for an entertainment storage device which is compatible with the decor of a large range of rooms, regardless of the size of the room.

SUMMARY OF THE INVENTION

It is therefore one object to provide a storage device for a video display device which conceals the video display when not in use in a manner which does not require the opening of a cabinet door.

It is a more specific object of the present invention to provide a storage device for a video display device which conceals the video display with a two-way mirror.

According to a presently preferred embodiment, the storage device of the present invention includes an appropriately sized furniture-grade cabinet, such as a wardrobe or an armoire, and a two-way mirror. The wardrobe permits the video display to be positioned in an elevated location, permitting the video display to be comfortably viewed from a recumbent position. When the video display is not in use, the two-way mirror appears to be an ordinary mirror and conceals the presence of the video display. However, when the video display is in use, the light produced by the display is transmitted through the mirror, permitting the video display to be viewed through the two-way mirror. Advantageously, the material from which two-way mirror is constructed permits infrared signals from a remote control device for the video equipment to travel through the two-way mirror and control the video equipment. The functionality of the storage device may be further enhanced through the incorporation of several other features, including adjustable shelves and drawers.

Additional advantages and features of the present invention will become apparent from the subsequent description and the appended claims, taken in conjunction with the accompanying drawings.

BRIEF DESCRIPTION OF THE DRAWINGS

FIG. 3 is a cross-sectional view of the storage device of the present invention taken along line 3—3 in FIG. 1;

FIG. 3A is a cross-sectional view similar to that of FIG. 3 but showing an alternative construction of the door assembly;

FIG. 5 is a partial front view of the storage device of the present invention according to a first alternate embodiment;

FIG. 6 is a partial side view of the storage device of the present invention according to a second alternate embodiment; and FIG. 7 is a partial front view of the storage device of the present invention according to a second alternate embodiment.

DETAILED DESCRIPTION OF THE PREFERRED EMBODIMENT

Figure 1:
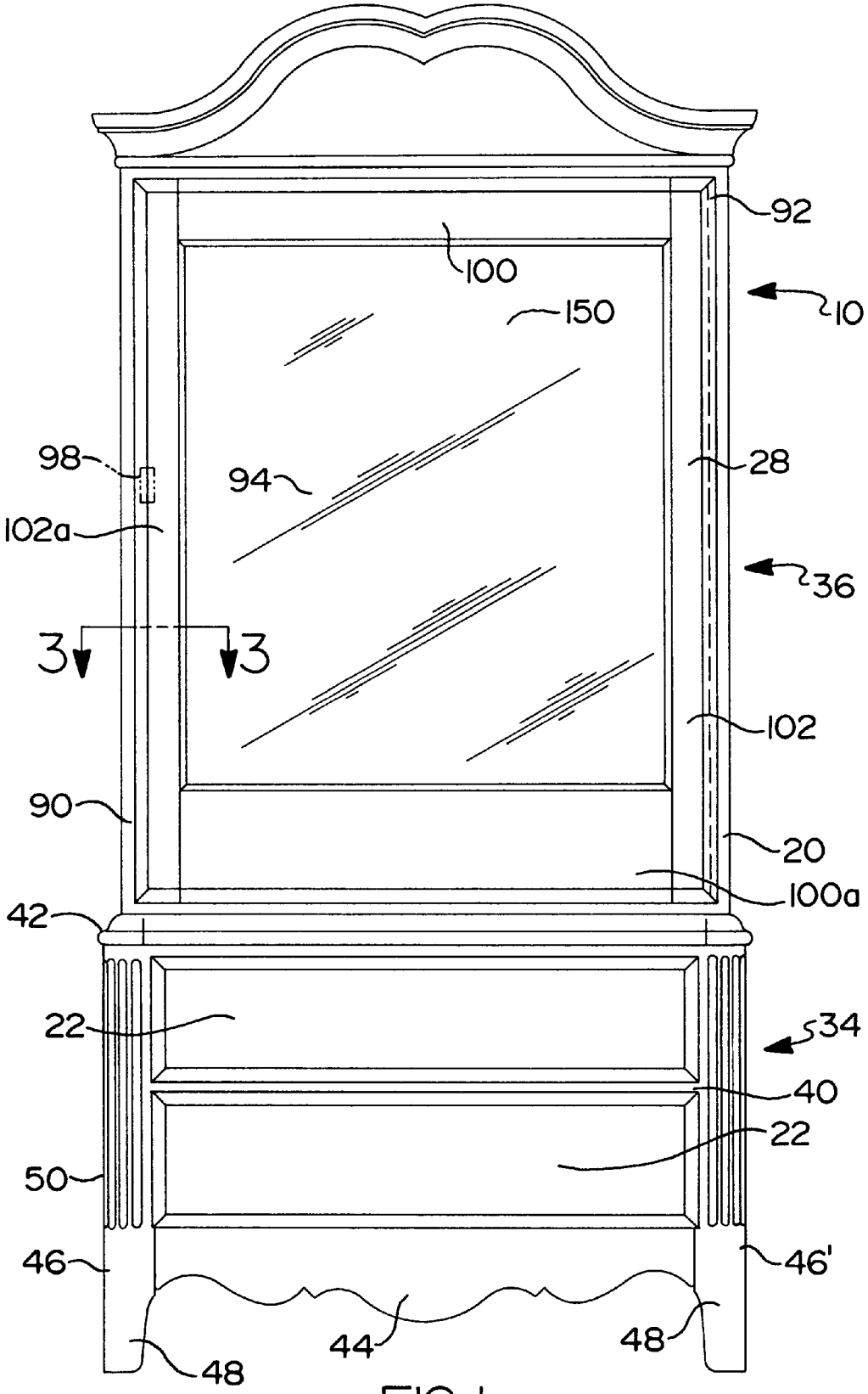
FIG. 1 is a front view of the storage device of the present invention as seen when the video display is not in use.
Figure 2:
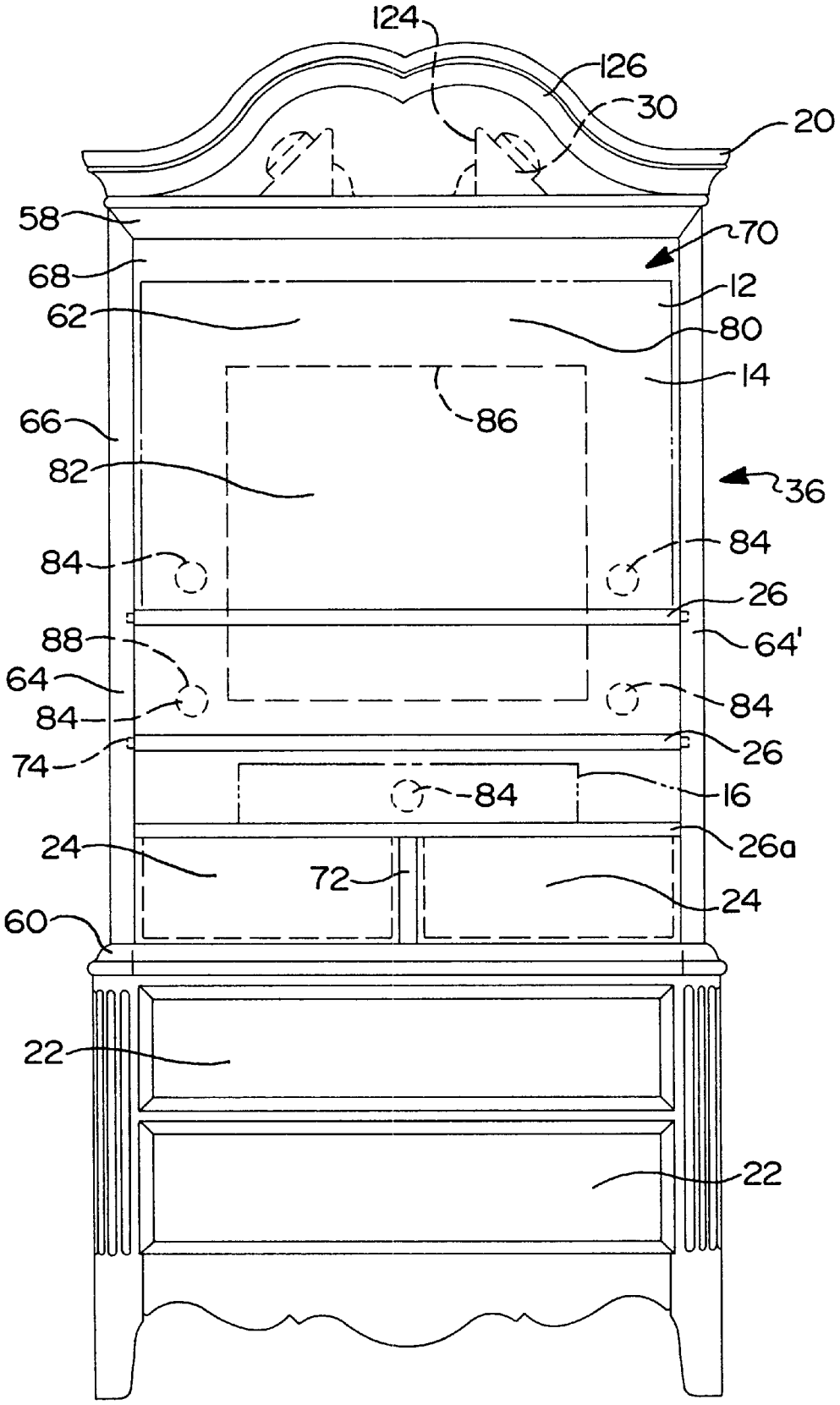
FIG. 2 is similar to FIG. 1 with the door assembly removed.
Figure 4:
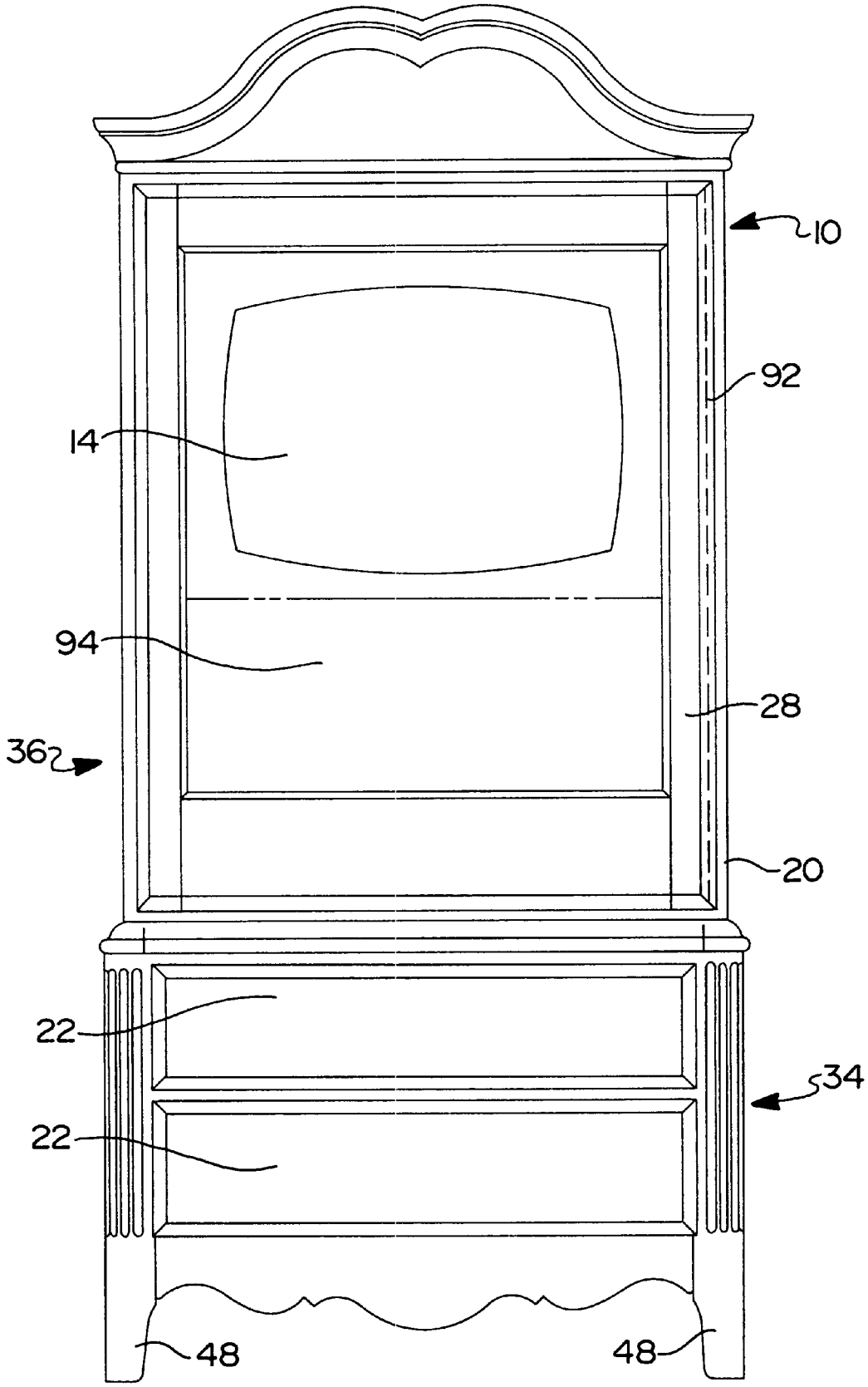
FIG. 4 is similar to FIG. 1 except that the video display is in use.

With reference to FIGS. 1 and 2 of the drawings, the storage device of the present invention is generally indicated by reference numeral 10 which is shown to be operatively associated with a video display 12, such as a television 14, and a video cassette recorder (VCR) 16. Storage device 10 includes a cabinet frame 20, a plurality of first drawers 22, a plurality of second drawers 24, a plurality of shelves 26, a door assembly 28 and means for transmitting sound 30.

Cabinet frame 20 is shown to include a lower portion 34 and an upper portion 36. Lower portion 34 includes a base rail 40 and a top panel 42, a bottom (not shown), a rear panel (not shown), a front panel 44 and opposite side panels 46 and 46' which cooperate to define a plurality of first drawer apertures (not shown) through which first drawers 22 are received. Opposite panels 46 and 46' are fitted with legs 48 which support cabinet frame 20. Preferably, opposite side panels 46 and 46' include decorative moldings or engravings, such as chamfering 50, or the like, which enhance the aesthetic effect produced by storage device 10.

Upper portion 36 includes top, bottom, rear and opposite side panels 58, 60, 62, 64 and 64', respectively, which cooperate to define a container structure 66 having a cabinet front opening 68 with a storage cavity 70 into which shelves 26, television 14 and VCR 16 are received. A mullion 72 and shelf 26*a* are coupled together to define a plurality of second drawer apertures (not shown) through which second drawers 24 are received. Shelf 26*a* is fixed to opposite side panels 64 and 64' and mullion 72 is fixed to shelf 26*a* and bottom panel 60.

Opposite side panels 64 and 64' include a plurality of engagement apertures (not shown) which cooperate in a conventional manner with the engagement members 74 of shelves 26 to permit shelves 26 to be selectively positioned along the height of opposite side panels 64 and 64' at a plurality of predetermined height intervals.

Rear panel 62 includes a panel portion 80, a knock-out panel 82 and a plurality of knock-out plugs 84. Panel portion 80 is fixedly secured to top panel 58 and opposite side panels 64 and 64'. Knock-out panel 82 is defined by a plurality of perforations 86 in rear panel 60 which permit knock-out panel 82 to be selectively removed from rear panel 60 in the event that the depth of video display 12 is greater than the depth of upper portion 36. Knock-out plugs 84 are similarly defined by a plurality of perforations 88 in rear panel 60 which permit knock-out plugs 84 to be selectively removed from rear panel 60. Knock-out plugs 84 permits the various cords and cables (not shown) associated with the video equipment in storage device 10 to be conveniently routed to a location remote from storage device 10 in a concealing manner.

With additional reference to FIG. 3, door assembly 28 is shown to include a door frame 90, a hinge assembly 92, a two-way mirror 94, a resilient member 96 and a latch mechanism 98. It will be understood, however, that the particular door assembly shown is merely illustrative of one possible configuration of the door assembly and as such, is not intended to be limiting in any manner. In the particular embodiment illustrated, door frame 90 is generally rectangular in shape and includes a plurality of horizontal and vertical members 100 and 102, respectively, which cooperate to form a structure having a mirror aperture 104. Mirror aperture 104 is shown to include a generally flat ledge 106, a generally U-shaped groove 108 and a decorative border 110. Ledge 106, U-shaped groove 108 and border 110 extend around the perimeter of mirror aperture 104 into horizontal and vertical members 100 and 102, respectively.

Two-way mirror 94 is preferably fabricated from an architectural-grade mirrored glass having a clear glass substrate layer 120 and a silver-colored reflective layer 122. Two-way mirror 94 may have a transmittance of between approximately 30% to 70% and a reflectance of between approximately 30% to 70%. Preferably, however, the transmittance of two-way mirror 94 is between approximately 40% to 60% and the reflectance is between approximately 40% to 60%. The architectural-grade mirrored glass produced by Libbey Owens Ford and marketed under the trademark ECLIPSE® is an example of a suitable material for two-way mirror 94. Two-way mirror 94 is disposed within mirror aperture 104 such that it abuts ledge 106. Resilient member 96 is inserted into U-shaped groove 108 and is operable for retaining two-way mirror 94 in mirror aperture 104, as well as dampening vibrations generated by the sound produced by the audio speakers (not shown) of television 14 which are transmitted through two-way mirror 94 to door frame 90.

Hinge assembly 92 pivotably connects door frame 90 to side panel 64' and permits door frame 90 to be moved between a fully closed position and a fully open position. Latch mechanism 98 is positioned on vertical member 102*a* and is operable between an unlatched position for permitting pivotal movement of hinge assembly 92, and a latched position for inhibiting pivotal movement of hinge assembly 92 wherein vertical member 102*a* is secured to side panel 64. Placement of latch mechanism 98 in the latched position prevents door frame 90 from vibrating against side panel 64. Alternatively, as shown in FIG. 3A, a resilient bumper 98' may be included in door assembly 90, either in combination with or in place of latch mechanism 98 to isolate door frame 90 from direct contact with side panel 64 and dampen vibrations generated by the sound produced by the audio speakers of television 14 which are transmitted between door frame 90 and side panel 64.

Sound transmitting means 30 is operable for transmitting an audio signal associated with a video signal shown on video display 12. Preferably, sound transmitting means includes one or more auxiliary speakers 124 which are placed behind the crown 126 on top panel 58. Positioning auxiliary speakers 124 in this manner conceals their location yet permits them to be readily repositioned to direct sound in a desired direction. The use of auxiliary speakers 124 eliminates the need to transmit sound from upper portion 36 and permits the audio speakers of television 14 to be switched to an "off" control position. Auxiliary speakers 124 are coupled to the audio output jacks (not shown) of television 14 through conventional cabling (not shown). With reference to FIG. 5, auxiliary speakers 124 may alternatively be mounted to cabinet frame 20' into, for example, opposite side panels 64*b*, and/or in crown 14*a* to thereby partially conceal their location.

Alternatively, sound transmitting means 30' may be formed in the opposite side panels 64*a* of cabinet frame 20" as shown in FIG. 6 or door assembly 28" as shown in FIG. 7 to permit the sound produced by the audio speakers of television 14 to be transmitted through upper portion 36 without substantially degrading the quality of the audio signal. Preferably, sound transmitting means 30' is an acoustic vent 130 which includes a horizontal slotted aperture 132 formed in horizontal member 100*a* and a grille 134 which conceals slotted aperture 132. Grille 134 is preferably an acoustically-transparent material and may be fabricated from a fabric, or from a perforated solid material such as wood, plastic or metal. In addition to facilitating the transmission of sound through storage device 10, acoustic vent 130 is also operable for permitting heat generated by television 14 and VCR 16 to escape from storage cavity 70. With reference to FIG. 6, one or more acoustic vents 130' may alternatively be included in opposite side panels 64 and 64' in addition to the placement of acoustic vent 130 in horizontal member 100*a* or to eliminate the placement of acoustic vent 130 in horizontal member 100*a*.

Shelves 26 are placed at a desired height in upper portion 36 to permit television 14 and VCR 16 to be monitored and operated from a comfortable position. Engagement members 74 are then coupled into their respective engagement apertures to secure shelves 26 to opposite panels 64 and 64'.

When door frame 90 is placed in the closed position and television 14 is riot in use, light is not being produced in storage cavity 70 and light reflected from two-way mirror 94 is readily viewable. Operation of storage device 10 in this mode provides the impression that two-way mirror 94 is a standard reflective (i.e., one-way) mirror. However, when door frame 90 is placed in the closed position and television 14 is in use, light produced by television 14 is transmitted through two-way mirror 94 enabling persons situated proximate storage device 10 to view television 14. Advantageously, the material from which two-way mirror 94 is constructed does not reflect all of the light which strikes the front face 150 of two-way mirror 94, thereby allowing the use of conventional infrared remote control devices (not shown) with television 14 and VCR 16.

While the invention has been described in the specification and illustrated in the drawings with reference to a preferred embodiment, it will be understood by those skilled in the art that various changes may be made and equivalents may be substituted for elements thereof without departing from the scope of the invention as defined in the claims. In addition, many modifications may be made to adapt a particular situation or material to the teachings of the invention without departing from the essential scope thereof. Therefore, it is intended that the invention not be limited to the particular embodiment illustrated by the drawings and described in the specification as the best mode presently contemplated for carrying out this invention, but that the invention will include any embodiments falling within the description of the appended claims.

What is claimed is:

1. A storage device comprising:

a cabinet frame including a top panel, a bottom panel, and opposing side panels, said panels cooperating to form a container structure having a cabinet front opening and a storage cavity; and a door assembly covering said storage cavity, said door assembly including a hinge assembly and a closure portion, said closure portion including a two-way mirror, a door frame member and a resilient member, said door frame member coupled to said hinge assembly and said two-way mirror, said door frame member including a mirror aperture, said hinge assembly pivotably coupling said closure portion and said cabinet frame, said resilient member abutting said two-way mirror and adapted for dampening vibrations transmitted between said door frame member and said two-way mirror;

wherein said door frame member includes a ledge extending about a perimeter of said mirror aperture, said ledge abutting a first surface of said two-way mirror and said resilient member abutting a second surface of said two-way mirror.

2. The storage device of claim 1 wherein said two-way mirror has a transmittance of between approximately 30 to 70% and a reflectance of between approximately 30 to 70%.

3. The storage device of claim 2 wherein said two-way mirror has a transmittance of between approximately 40 to 60% and a reflectance of between approximately 40 to 60%.

4. The storage device of claim 1 further comprising a back panel having a panel portion and a knock-out panel.

5. The storage device of claim 1 wherein said door frame member includes an acoustic aperture adapted for transmitting sound out of said storage cavity.

6. The storage device of claim 1 further comprising an acoustic aperture formed in said cabinet frame, said acoustic aperture adapted for transmitting sound out of said storage cavity.

7. The storage device of claim 1 further comprising an acoustic speaker concealed at least partially by said cabinet frame.

8. The storage device of claim 7 wherein said acoustic speaker is coupled to said cabinet frame.

9. A storage device comprising:

a cabinet frame including a top panel, a bottom panel, a rear panel and opposing side panels, said panels cooperating to form a container structure having a cabinet front opening and a storage cavity, said rear panel including a rear panel portion and a knock-out panel;

a door assembly having a hinge assembly, and a closure portion, said door assembly covering said storage cavity, said hinge assembly pivotably coupling said closure portion and said cabinet frame such that said closure portion is operable between an open position and a closed position, said closure portion including a transparent member, a reflective member, a door frame member and a resilient member, said door frame member coupled to said hinge assembly, said resilient member, said transparent member and said reflective member, said door frame member including a mirror aperture, said resilient member abutting one of said transparent member and said reflective member and adapted for dampening vibrations transmitted between said door frame member and said transparent and reflective members, said reflective member coupled to said transparent member and adapted for reflecting at least a portion of the light generated by a light source exterior to said storage cavity to thereby obscure said storage cavity from view when light is not being produced within said storage cavity and said door frame is in said closed position, said reflective member also adapted for transmitting at least a portion of the light generated by a light source disposed within said storage cavity, said transparent member and said reflective member cooperating to form a two-way mirror, said door frame member having a ledge extending about a perimeter of said mirror aperture, said ledge abutting a first surface of said two-way mirror and said resilient member abutting a second surface of said two-way mirror.

10. The storage device of claim 9 further comprising an acoustic aperture formed in said cabinet frame, said acoustic aperture adapted for transmitting sound out of said storage cavity.

11. The storage device of claim 9 further comprising an acoustic speaker concealed at least partially by said cabinet frame.

12. The storage device of claim 11 wherein said acoustic speaker is coupled to said cabinet frame.

13. A storage device comprising:

a cabinet frame including a top panel, a bottom panel, a rear panel and opposing side panels, said panels cooperating to form a container structure having a cabinet front opening and a storage cavity, said rear panel including a rear panel portion and a knockout panel;

a door frame covering said storage cavity, said door frame having a mirror aperture and a ledge, the ledge extending about a perimeter of said mirror aperture;

a hinge assembly pivotably coupling said door frame and said cabinet frame such that said door frame is operable between an open position and a closed position;

a transparent member coupled to said door frame;

a reflective member coupled to said transparent member, said reflective member adapted for reflecting at least a portion of the light generated by a light source exterior to said storage cavity to thereby obscure said storage cavity from view when light is not being produced within said storage cavity and said door frame is in said closed position, said reflective member also adapted for transmitting at least a portion of the light generated by a light source disposed within said storage cavity;

a resilient member coupled to said two-way mirror and said door frame, said resilient member adapted for dampening vibrations transmitted between said door frame and said two-way mirror; and an acoustic speaker concealed at least partially by said cabinet frame;

wherein said ledge abuts a first surface of said two-way mirror and said resilient member abuts a second surface of said two-way mirror.

* * * * *